US008226382B2

(12) United States Patent
Vogt

(10) Patent No.: US 8,226,382 B2
(45) Date of Patent: Jul. 24, 2012

(54) FEED PUMP IN A MOTOR VEHICLE

(75) Inventor: Dipl-Ing Heiko Vogt, Minfeld (DE)

(73) Assignee: Daimler AG, Stuttgart (DE)

( * ) Notice: Subject to any disclaimer, the term of this patent is extended or adjusted under 35 U.S.C. 154(b) by 619 days.

(21) Appl. No.: 12/229,058

(22) Filed: Aug. 19, 2008

(65) Prior Publication Data

US 2009/0047149 A1 Feb. 19, 2009

Related U.S. Application Data

(63) Continuation-in-part of application No. PCT/EP2007/001151, filed on Feb. 10, 2007.

(30) Foreign Application Priority Data

Feb. 24, 2006 (DE) ..... 10 2006 008 757

(51) Int. Cl.
*F04B 17/05* (2006.01)
*B60K 17/06* (2006.01)

(52) U.S. Cl. ..... 417/410.4; 180/369

(58) Field of Classification Search ..... 417/355, 417/362, 364, 410.4, 223, 319; 418/206.6, 418/206.1–206.2, 165, 166, 171; 180/305–307, 180/367, 369, 374; 475/162, 163; 74/640
See application file for complete search history.

(56) References Cited

U.S. PATENT DOCUMENTS

| | | | | |
|---|---|---|---|---|
| 3,742,782 | A * | 7/1973 | Doran | 475/108 |
| 4,295,807 | A * | 10/1981 | Kruger | 418/170 |
| 4,827,881 | A * | 5/1989 | Baker et al. | 123/196 R |
| 5,395,217 | A * | 3/1995 | Hoffmann et al. | 417/362 |
| 5,795,137 | A | 8/1998 | Ozawa et al. | |
| 5,823,750 | A * | 10/1998 | Hoffmann et al. | 417/310 |
| 6,460,503 | B2 * | 10/2002 | Kinoshita et al. | 123/196 R |
| 6,497,565 | B2 * | 12/2002 | Inaguma et al. | 418/259 |
| 6,685,437 | B2 * | 2/2004 | Koenig et al. | 417/15 |
| 2003/0035742 | A1 * | 2/2003 | Vukovich et al. | 417/374 |
| 2005/0100455 | A1 * | 5/2005 | Tuddenham | 417/410.3 |
| 2005/0207915 | A1 * | 9/2005 | Fledersbacher et al. | 417/410.1 |
| 2005/0244284 | A1 * | 11/2005 | Kolb | 417/366 |
| 2005/0265858 | A1 * | 12/2005 | Klaus et al. | 417/374 |

FOREIGN PATENT DOCUMENTS

| | | |
|---|---|---|
| DE | 199 32 359 | 2/2000 |
| DE | 101 17 517 | 10/2002 |
| DE | 102 14 637 | 10/2003 |
| WO | WO 99/10655 | 3/1999 |

* cited by examiner

*Primary Examiner* — Devon C Kramer
*Assistant Examiner* — Bryan Lettman
(74) *Attorney, Agent, or Firm* — Klaus J. Bach

(57) ABSTRACT

In an engine driven unit of a feed pump, the feed pump is accommodated in a hollow space which is enclosed radially by a rotating functional wheel of a component of the motor vehicle formed, for example, by a pulley wheel, which may be driven directly by the crankshaft of the internal combustion engine.

3 Claims, 3 Drawing Sheets

FEED PUMP IN A MOTOR VEHICLE

This is a Continuation-in-Part Application of pending international patent application PCT/EP2007/001151 filed Feb. 10, 2007 and claiming the priority of German patent application 10 2006 008 757.7 filed Feb. 24, 2006.

BACKGROUND OF THE INVENTION

The invention relates to a feed pump in a motor vehicle having an engine-driven feed unit and a rotating functional wheel of an assembly of the motor vehicle.

DE 199 32 359 A1 discloses a coolant pump for the coolant circuit of an internal combustion engine in a motor vehicle, comprising a pulley which can be driven by the engine and a coolant impeller which is driven via a fluid friction clutch. The coolant impeller is seated on a shaft, on which the pulley wheel is mounted without rotational coupling, the pulley wheel being driven by the internal combustion engine of the motor vehicle via a belt drive. The fluid friction clutch is integrated into the pulley wheel, the former comprising a rotor which is connected to the shaft and is driven by the pulley wheel via shear forces which are transmitted via a viscous fluid, with the result that the coolant impeller is also driven via the force flow which is transmitted from the pulley wheel and the rotor via the viscous fluid. Said coolant impeller is positioned axially in front of the pulley wheel, as a result of which the whole apparatus is of comparatively large overall size.

It is the object of the present invention to provide a compact feed pump in a motor vehicle.

SUMMARY OF THE INVENTION

In an engine driven unit of a feed pump, the feed pump is accommodated in a hollow space which is enclosed radially by a rotating functional wheel of a component of the motor vehicle formed, for example, by a pulley wheel, which may be driven directly by the crankshaft of the internal combustion engine.

Because of the integration of the feed pump into the hollow space which is enclosed by the functional wheel, a very compact embodiment is achieved, in particular in an axial direction, since, in comparison with embodiments known in the state of the art, the installation space which is required in the axial direction is not, or only slightly, greater than the installation space for the feed unit without the functional wheel. An impairment of the methods of operation both of the feed pump and of the functional wheel is not to be expected as a result of the integration of the feed unit into the hollow space, since in principle the functions of both structural units can be carried out independently of one another. According to one advantageous embodiment, it can be expedient, however, to directly or indirectly couple a drive wheel of the feed pump, which is accommodated in the hollow space, to the functional wheel, with the result that an additional drive motor for the feed pump is obsolete.

The component, in which the feed unit is accommodated, is expediently a bearing journal, on which the functional wheel is mounted rotatably. There is provision according to a further advantageous embodiment for the pump housing, in which the feed unit of the feed pump is accommodated, to form the bearing journal at the same time. The accommodation in the bearing journal has the advantage of a positionally fixed support device for the feed unit, combined with the accommodation within a hollow space which is enclosed radially by the functional wheel.

Furthermore, it can be expedient to provide a transmission element between the functional wheel and the drive wheel of the feed unit, as a result of which the rotational coupling is established between the drive wheel and the functional wheel. This transmission element is configured, in particular, as a shaft between the drive wheel and the functional wheel, said shaft forming at the same time the rotational axis of both the drive wheel and the functional wheel according to a first preferred embodiment. This embodiment is distinguished by a simple design, since it is sufficient if the shaft of the drive wheel extends through a wall of the bearing journal and is coupled to a wall of the functional wheel which reaches over the end side of the bearing journal.

According to a second, alternative embodiment, however, it may also be advantageous if the rotational axes of the drive wheel of the feed unit and the functional wheel do not coincide, but rather extend in parallel relationship and are spaced from one another. In this embodiment, the drive wheel and the functional wheel are rotationally coupled indirectly via an intermediate wheel which is connected in between, as a result of which rotational speed step up or step down ratios can be realized. It is possible, in particular, to implement a rotational speed transmission ratio which is greater than one, with the result that the feed pump has a higher rotational speed than the functional wheel. In order to maintain a compact overall size despite the additional intermediate wheel, the functional wheel is advantageously configured as an outer gear having an internal toothing system, in which the intermediate wheel is provided as an inner gear and meshes with the internal toothing system of the outer gear. Because of the tooth engagement between the functional wheel and the intermediate gear, a positive force transmission is provided; non-positive couplings between the intermediate gear and the functional wheel can also be suitable in principle, however.

If an intermediate gearwheel is provided, its shaft advantageously at the same time forms the shaft of the drive wheel of the feed unit whereby a further design simplification is achieved.

The feed pump is configured, for example, as a gear pump, in particular as an external gear pump, in which the medium to be fed is transported via two gearwheels which mesh with one another in each case between the outer teeth of the gearwheels and the housing inner wall. One of the two gearwheels is configured as a drive wheel which is driven directly or indirectly by the functional wheel via the shaft.

However, it can also be expedient according to a further embodiment to decouple the drive of the feed pump from the functional wheel and to configure it separately therefrom. In this case, a rotational coupling is not required between the drive wheel of the feed pump and the functional wheel.

The invention and expedient embodiments thereof will become more readily apparent from the following description thereof on the basis of the accompanying drawings:

In the various figures, identical components are provided with identical designations in the figures.

DESCRIPTION OF PARTICULAR EMBODIMENTS

Figure 1:
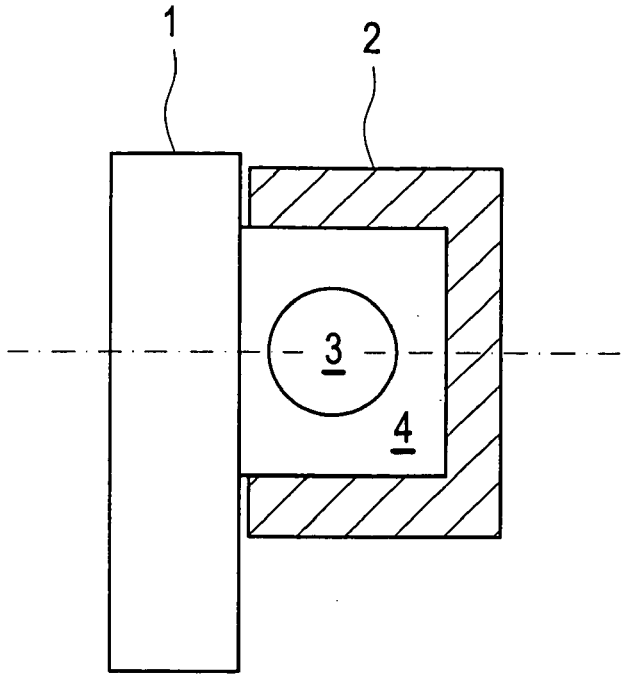
FIG. 1 shows in a diagrammatic illustration a feed pump which is arranged in a hollow or inner space of a cup-shaped functional wheel, the functional wheel being supported on a component of the motor vehicle and the open side of the functional wheel facing said further component.

The component 1 which is shown in FIG. 1 is a motor vehicle component, for example a crankcase of an internal combustion engine, in particular the closure cover of the crankcase, where the crankshaft protrudes out of the crankcase and drives diverse pulleys and wheels for driving the auxiliary assemblies of the internal combustion engine. A functional wheel 2 is mounted rotatably on the component, the functional wheel 2 being a pulley wheel or the like for example. The functional wheel 2 is configured as a hollow body and has, in particular, a cup shape, as a result of which an inner or hollow space 4 is formed in the functional wheel 2. A feed pump which is denoted by the numeral 3 in general is accommodated in this hollow space 4, which feed pump is, for example, an oil feed pump or a coolant circulating pump. The feed unit of the feed pump 3 is expediently configured as a gear pump, in particular an external gear pump, other pump embodiments also being suitable such as vane cell pumps. The fluid to be pumped is supplied to the suction side and discharged on the pressure side via the feed pump 3.

The open side of the functional wheel 2 of cup-shaped configuration which is mounted rotatably on the component 1 faces a side wall of the component 1. The feed pump 3 is driven either by means of a kinematic coupling via the functional wheel 2 or else, according to an alternative embodiment, independently of the functional wheel 2 via a separate drive motor. The feed pump 3 is accommodated completely in the hollow space 4 of the functional wheel 2.

Figure 2:
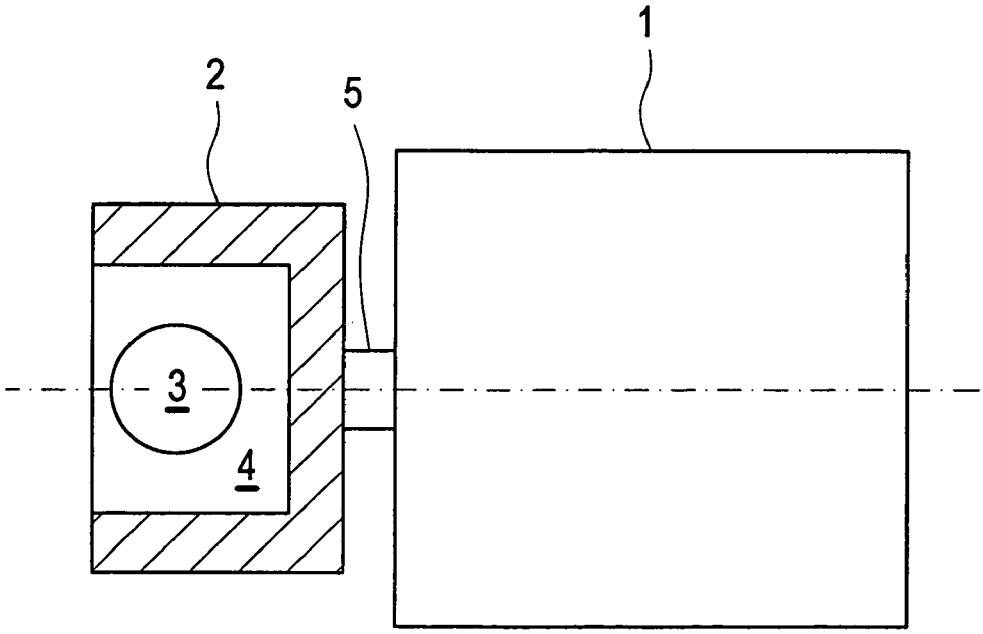
FIG. 2 shows an illustration which corresponds to FIG. 1 with a cup-shaped functional wheel and a feed pump which is accommodated therein; the open side of the functional wheel facing away from the support component.

The exemplary embodiment according to FIG. 2 differs from that according to FIG. 1 to the extent that the open end of the functional wheel 2 of cup-shaped configuration faces away from the component 1. The functional wheel 2 is driven via a drive shaft 5 which protrudes from the component 1. The drive shaft 5 at the same time forms the rotational mounting of the functional wheel 2. The feed pump 3 is accommodated in the inner or hollow space 4 of the functional wheel 2.

Figure 3:
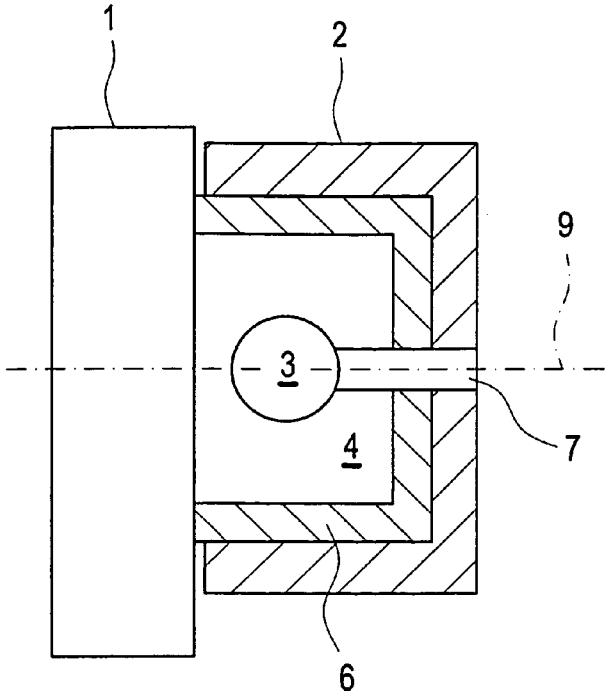
FIG. 3 shows a further exemplary embodiment with a cup-shaped functional wheel which is mounted rotatably on a bearing journal which is configured as a hollow body and which is disposed on a component of the motor vehicle, a feed pump being integrated into the hollow space of the bearing journal, and the drive wheel of said feed pump being rotationally coupled to the functional wheel via a shaft piece.

In the exemplary embodiment which is shown in FIG. 3, the functional wheel 2 is likewise of cup-shaped configuration, the open side of the functional wheel facing the component 1. The functional wheel 2 is mounted rotatably on a bearing journal 6 which is connected fixedly to the component 1. The bearing journal 6 protrudes into the hollow space of the functional wheel 2 and likewise has a hollow space 4, in which the feed pump 3 is accommodated completely. A drive wheel of the feed unit of the feed pump 3 is rotationally coupled to the functional wheel 2 via a shaft 7. The shaft 7 lies in the rotational axis 9 of the functional wheel 2 which at the same time forms the rotational axis of the drive wheel of the feed unit of the feed pump. The shaft 7 penetrates the end wall of the stationary bearing journal 6 and establishes a rotational coupling between the end wall of the functional wheel 2 and the drive wheel of the feed pump 3.

Figure 4:
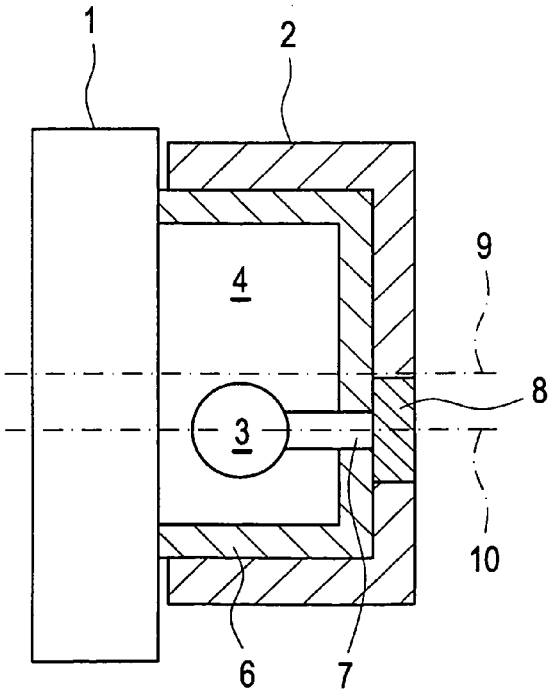
FIG. 4 shows a further embodiment with a feed pump arranged in the hollow space of a bearing journal for the functional wheel and the drive wheel of which is rotationally coupled, however, via shaft piece to an intermediate wheel that meshes as an inner wheel with the internal toothing system of the functional wheel.
Figure 5:
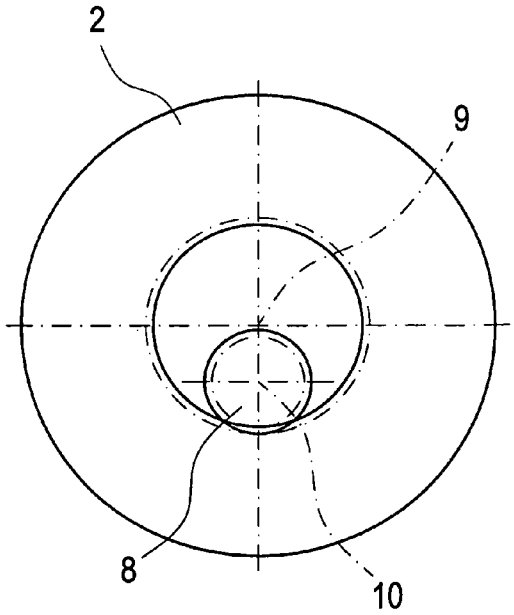
FIG. 5 shows the embodiment according to FIG. 4 in an end-side view.

In the exemplary embodiment according to FIG. 4, the drive wheel of the feed pump 3 is mounted eccentrically with respect to the functional wheel 2. Accordingly, the rotational axis 9 of the functional wheel 2 and the rotational axis 10 of the drive wheel of the feed pump 3 are disposed in parallel spaced relationship. The feed pump 3 is once again accommodated completely in the hollow space 4 of the bearing journal 6, but an intermediate wheel 8 is connected in the transmission path between the drive wheel of the feed pump 3 and the functional wheel 2, which intermediate wheel 8 has the same rotational axis 10 as the drive wheel of the feed pump 3 and is therefore mounted eccentrically in relation to the functional wheel 2. As can be gathered, in particular, from the end-side view according to FIG. 5, the intermediate wheel 8 is configured as a rotatable internal wheel which is mounted in a stationary manner and meshes with the internal toothing system of the functional wheel 2 which is configured as an internal gear. The shaft 7 of the intermediate wheel 8 is rotationally coupled to the drive wheel of the feed pump 3. In this way, a rotational movement of the functional wheel 2 is first of all transmitted to the intermediate wheel 8 and from the latter further to the drive wheel of the feed pump 3. A rotational speed step up ratio with a transmission ratio which does not equal one is possible between the functional wheel 2 and the drive wheel of the feed pump 3 via the size ratios of the functional wheel 2 and the intermediate wheel 8. In particular, rotational speed step up ratios which are greater than one can be realized, which leads to a higher rotational speed of the feed pump than the functional wheel 2.

Figure 8:
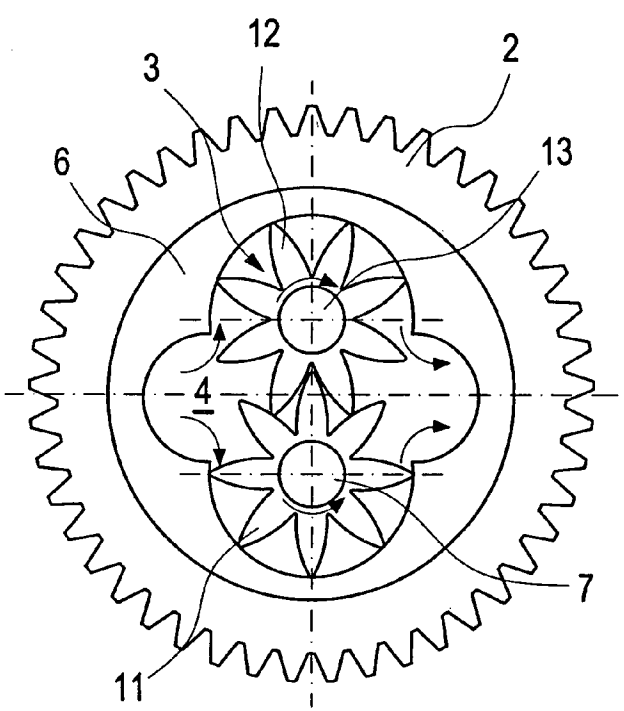
FIG. 8 is a view of the rear side of the embodiments according to FIGS. 6 and 7 with an illustration of the feed pump which is configured as an external gear pump.
Figure 7:
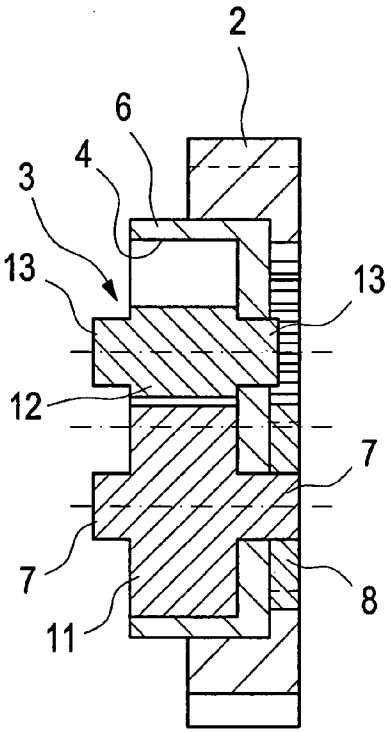
FIG. 7 shows a section through the arrangement according to FIG. 6 along the sectional line VII-VII.
Figure 6:
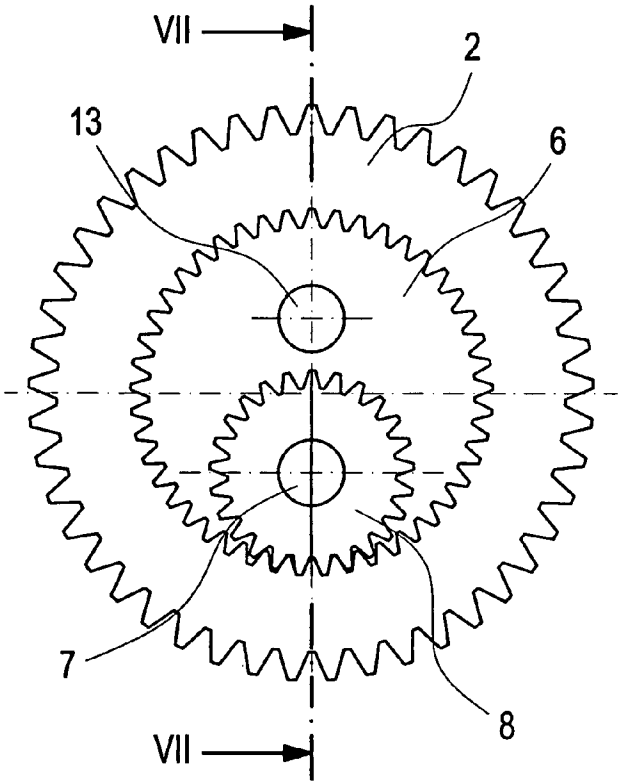
FIG. 6 is an end-side view of an exemplary embodiment which corresponds to FIGS. 4 and 5 and in which the functional wheel which is configured as an internal gear has also an external toothing system in addition to the internal toothing system which meshes with the intermediate wheel.

FIGS. 6 to 8 show the feed pump 3 and the drive of the feed pump via the functional wheel 2 and the intermediate wheel 8 which meshes with the latter. As can be gathered from FIG. 6 in conjunction with FIG. 7, the functional wheel 2 is configured as an internal gear with an external toothing system and an internal toothing system, the external toothing system meshing with a further component (not shown), for example a toothed belt, and the internal toothing system meshing with the intermediate wheel 8 which is mounted eccentrically with respect to the functional wheel 2. The shaft 7 of the intermediate wheel 8 is at the same time the shaft of the drive wheel 11 of the feed pump 3, as can be gathered from FIG. 7. The feed pump 3 is configured as an external gear pump with a total of two feed wheels, of which one forms the drive wheel 11 which meshes with the second feed wheel 12. Both wheels 11 and 12 have an involute toothing system, in which the medium to be fed, as can be gathered from the arrows which are shown in FIG. 8, is transported in the case of a rotation in opposite directions of the drive wheel 11 and the feed wheel 12 between the toothing system and the inner wall of the accommodating housing, which inner wall is the inner wall of the bearing journal 6 which accommodates the wheels 11 and 12 in the exemplary embodiment. The shaft 13 of the feed wheel 12 which meshes with the drive wheel 11 can also be seen in FIGS. 6 to 8.

The two wheels 11 and 12 of the feed pump 3 are accommodated in the hollow space 4 of the bearing journal 6, those shaft stubs of the shafts 7 and 13 of the wheels 11 and 12 which face away from the functional wheel 2 protruding axially out of the hollow space 4 in the bearing journal 6. Said shaft stubs 7 and 13 can be mounted in an adjoining component (not shown).

What is claimed is:

1. A feed pump in a motor vehicle having an engine-driven pumping unit with a pump housing (6) forming at a circumference a housing journal and being connected to a stationary component wall (1) of the motor vehicle so as to form together with the component wall (1) a hollow space (4), pump gears (11, 12) rotatably supported in the hollow space (4) in a spaced relationship and in a meshing engagement with each other, the hollow space having walls closely surrounding the pump gears (11, 12) and being provided with inlet and outlet openings for the admission and discharge of a feed fluid, a functional drive wheel (2) extending radially around, and being rotatably supported on, the housing journal and having an internal gear at a section thereof extending axially beyond the pump housing (6) at an axial end of the pump housing (6) opposite the stationary component wall (1), at least one of the pump gears (11, 12) having a drive shaft (7) extending through an opening in the pump housing (6) and carrying outside the pump housing (6) an intermediate gear (8) in a meshing engagement with the internal gear section of the functional drive wheel (2) so as to be driven by the functional drive wheel (2) upon rotation thereof on the housing journal.

2. The feed pump according to claim 1, wherein the functional drive wheel (2) is coupled to a drive means.

3. The feed pump according to claim 2, wherein the functional drive wheel includes a circumferential spur gear structure for coupling the functional drive wheel to the drive means.

* * * * *